US005133195A

United States Patent [19]

Appelbaum et al.

[11] Patent Number: 5,133,195

[45] Date of Patent: Jul. 28, 1992

[54] ORNAMENTAL JEWELRY SYSTEM

[75] Inventors: Stephen Appelbaum, 244 Concord Dr., Paramus, N.J. 07652; William A. Hoffer, Whippany, N.J.

[73] Assignee: Stephen Appelbaum, Paramus, N.J.

[21] Appl. No.: 692,914

[22] Filed: Apr. 29, 1991

Related U.S. Application Data

[63] Continuation-in-part of Ser. No. 545,692, Jun. 29, 1990, abandoned.

[51] Int. Cl.[5] ..... A44C 17/02

[52] U.S. Cl. ..... 63/29.1

[58] Field of Search ..... 63/12, 15, 26, 29.1, 63/15.7, 15.5, 15.45

[56] References Cited

U.S. PATENT DOCUMENTS

| | | | |
|---|---|---|---|
| 257,023 | 4/1882 | LaGrange | 63/15.5 |
| 899,296 | 9/1908 | Elliot | 63/15.7 |
| 4,393,667 | 7/1983 | Reinstein et al. | 63/29.1 |
| 4,697,437 | 10/1987 | D'Annunzio | 63/15.5 |

FOREIGN PATENT DOCUMENTS

| | | | |
|---|---|---|---|
| 634553 | 5/1929 | France | 63/29 |
| 783936 | 7/1935 | France | 63/29 |
| 925456 | 9/1947 | France | 63/29.1 |
| 1417745 | 10/1965 | France | 63/29.1 |
| 258386 | 5/1949 | Switzerland | 63/15 |

*Primary Examiner*—Rodney M. Lindsey
*Assistant Examiner*—Michael J. Milano
*Attorney, Agent, or Firm*—Samuelson & Jacob

[57] ABSTRACT

An improvement in an article of jewelry of the type in which an ornament, such as a jeweled setting, is selectively secured to or released from a support, such as a ring, merely by sliding a spline on the jeweled setting longitudinally into or out of a groove in a bridge coupled to the support, the bridge being coupled to the support solely by hinged connections at coupling locations so that the bridge is isolated from bending moments in the support at the coupling locations and the sliding movement is not impeded, the improvement including a latch for latching to secure the jeweled setting in place on the bridge and selective unlatching for releasing the jeweled setting from the bridge.

26 Claims, 5 Drawing Sheets

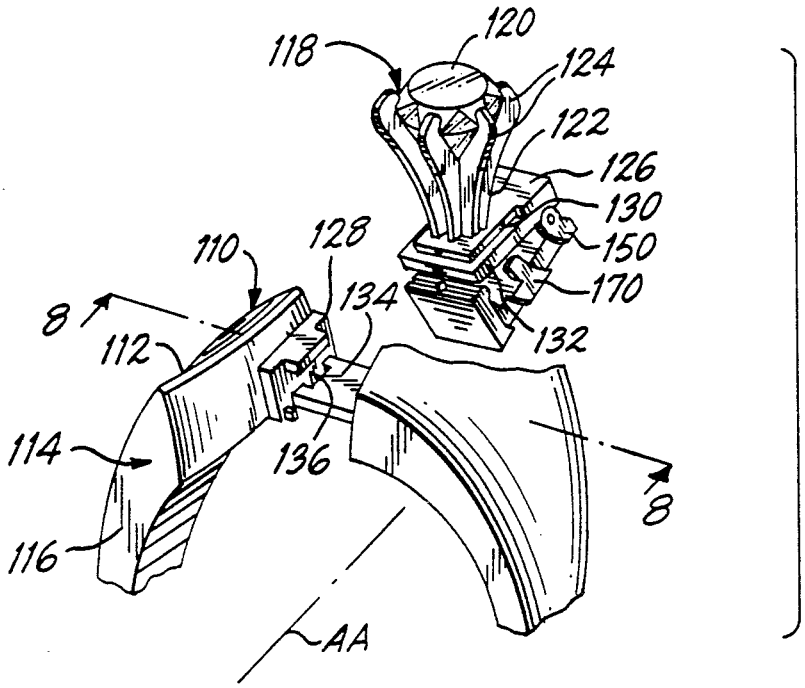
FIG. 6
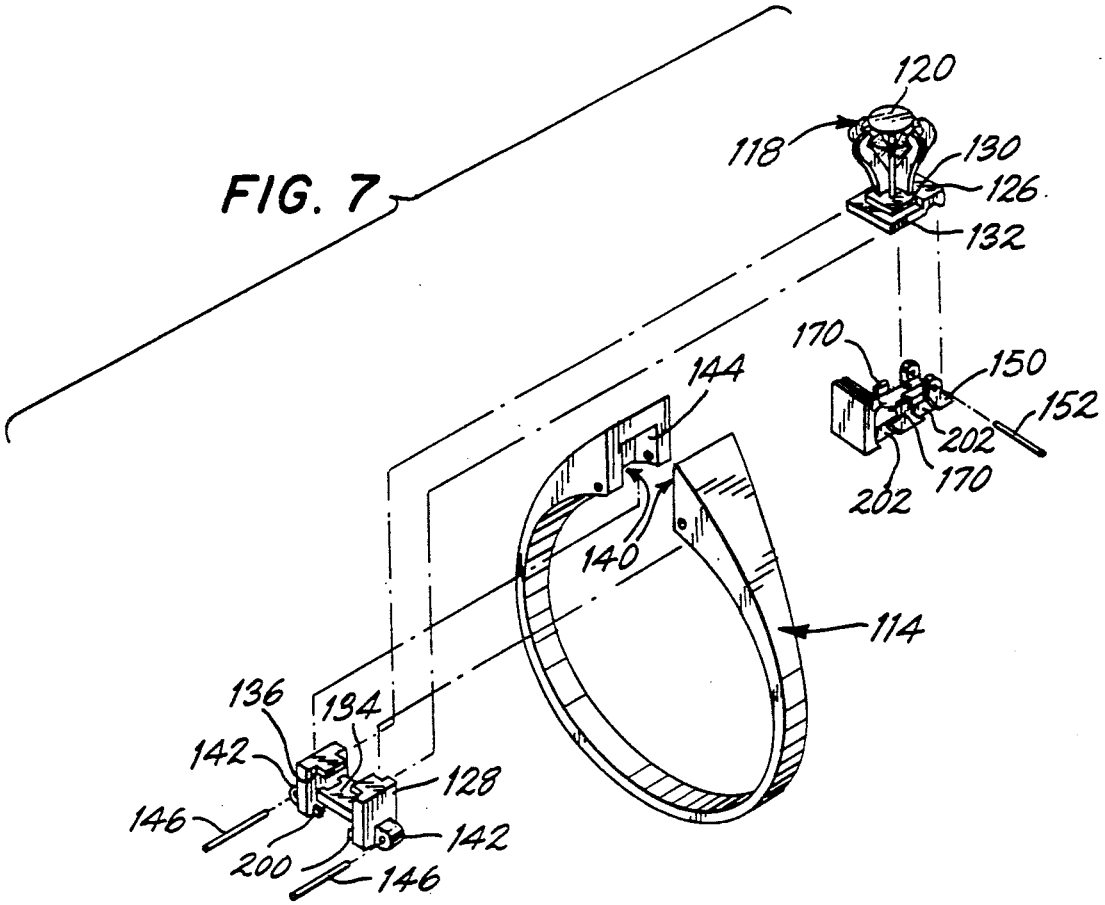

ORNAMENTAL JEWELRY SYSTEM

This is a continuation-in-part of application Ser. No. 545,692, filed Jun. 29, 1990, now abandoned.

The present invention relates generally to jewelry and pertains, more specifically, to an improvement in ornamental jewelry systems of the type in which a particular ornament, such a jeweled setting, may be affixed to any selected one of a plurality of supports for establishing a desired adornment of the person wearing the support.

The use of jewelry to accent and complement various styles of dress requires variety in the design and appearance of jewelry pieces. Thus, the most desirable wardrobes include many articles of jewelry, leading to considerable expense, in purchase as well as in upkeep and storage. Since the ornamental portion of a jewelry piece, such as a gemstone in a setting, often is the most dramatic element of the piece, and the most expensive element, it has been suggested that the versatility of jewelry can be increased, while expense can be reduced, by providing for the selective interchange of the ornamental portion from piece to piece. In that manner, a particularly prized ornament, such as a highly precious gemstone, can be secured, selectively, to any one of a variety of rings, pendants, pins, earrings, bracelets, necklaces and the like, thereby increasing the versatility of the gemstone while at the same time reducing the expenses of purchasing and maintaining a complete and flexible wardrobe.

A discussion of some of the advantages of such a construction in which jeweled settings can be interchanged is found in U.S. Pat. No. 4,393,667, in which various arrangements are disclosed for accomplishing interchangeability. However, the interchangeability accomplished by the structure suggested in the aforesaid patent is mostly for the convenience of the commercial supplier of jewelry, and not necessarily for the placement of a more versatile wardrobe in the hands of an individual end user. Consequently, the suggested constructions are relatively complex and are not easily operated by the person who will wear the jewelry.

The present invention provides an improvement in an article of jewelry of the type in which the ornamental portion of the article is secured or released selectively from the support portion of the article, and attains several objects and advantages, some of which are summarized as follows: Provides a jewelry system of simplified construction which is used readily by the wearer of jewelry to assemble a particular combination of ornament and support selected from a wide variety of such combinations made available by the improvement; enhances the ability to tailor a jewelry article to a particular style of dress without unduly multiplying the number of expensive ornaments required to provide a wide range of ornamented articles; opens new fields of fashion by rendering a wide variety of jewelry articles more available at lowered expense; provides a construction which is universal in the ability to accommodate almost any available ornamental element, including gemstones of essentially all sizes and cuts, so that the ornament is available for selection and placement by the wearer in combination with any one of a wide variety of supports; enables ease of interchange of the ornamental portion of an article of jewelry while providing a high degree of security once the ornamental portion is affixed to the support; avoids deleterious effects of stresses tending to distort the construction and impede ease of operation; and enables the construction of a highly desirable jewelry system of utmost quality and exemplary performance over a long service life.

The above objects and advantages, as well as further objects and advantages, are attained by the present invention which may be described briefly as an improvement in an article of jewelry of the type in which an ornament, such as a jeweled setting, is selectively secured to or released from a support, such as a ring, the improvement comprising: a basal platform affixed to the ornament and having a first connector element extending longitudinally along the basal platform; a bridge coupled with the support and having a second connector element extending longitudinally along the bridge and including laterally opposite sides; the first connector element and the second connector element having complementary lateral cross-sectional configurations such that the first connector element is engaged with the second connector element for longitudinally sliding movement into and out of a home position wherein the basal platform is fully seated upon the bridge, while relative movement between the first and second connector elements in lateral and altitudinal directions is precluded; a latch mounted for selective pivotal movement about a lateral axis between a latched position, wherein the bridge is captured between the basal platform and the latch for securement of the basal platform against movement relative to the bridge, and an unlatched position wherein the basal platform is free to move longitudinally relative to the bridge; clasp means for selectively securing the latch in the latched position when the first connector element is in the home position and for selective release from the latched position for permitting movement of the first connector element out of the home position; coupling means for coupling the bridge with the support at coupling locations spaced apart laterally and placed adjacent respective corresponding opposite sides of the second connector element such that the second connector element extends longitudinally intermediate the coupling locations and is spaced laterally from the coupling locations; whereby the selective securement and release of the ornament is accomplished solely by movement of the latch between the latched and unlatched positions and longitudinal sliding of the first connector element relative to the second connector element.

The invention will be understood more fully, while still further objects and advantages will become apparent, in the following detailed description of preferred embodiments of the invention illustrated in the accompany drawing, in which:

FIG. 6 is an exploded pictorial perspective view of a jeweled ring incorporating another embodiment of the improvement of the present invention;

Figure 4:
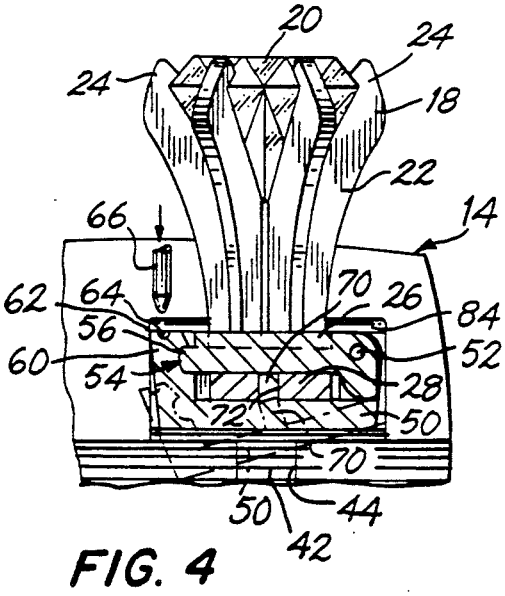
FIG. 4 is an enlarged longitudinal cross-sectional view taken along line 4—4 of FIG. 1.
Figure 8:
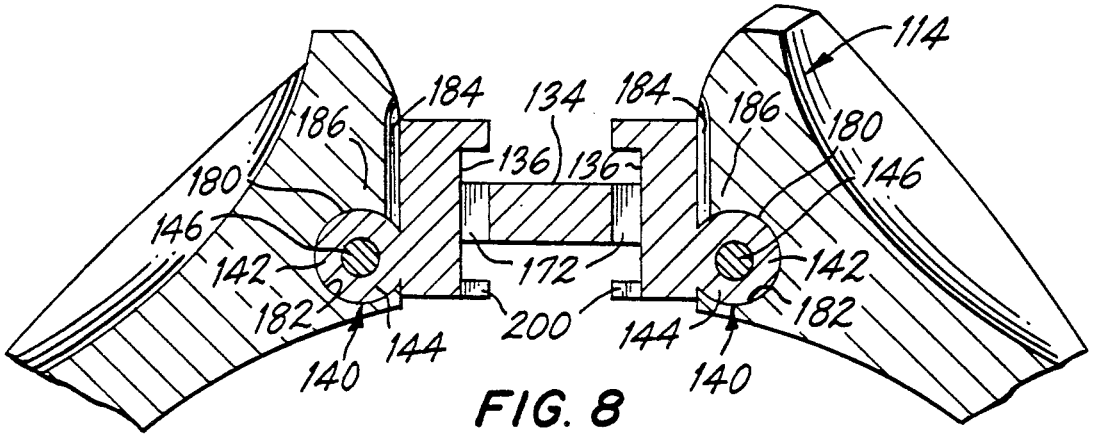
Figure 9:
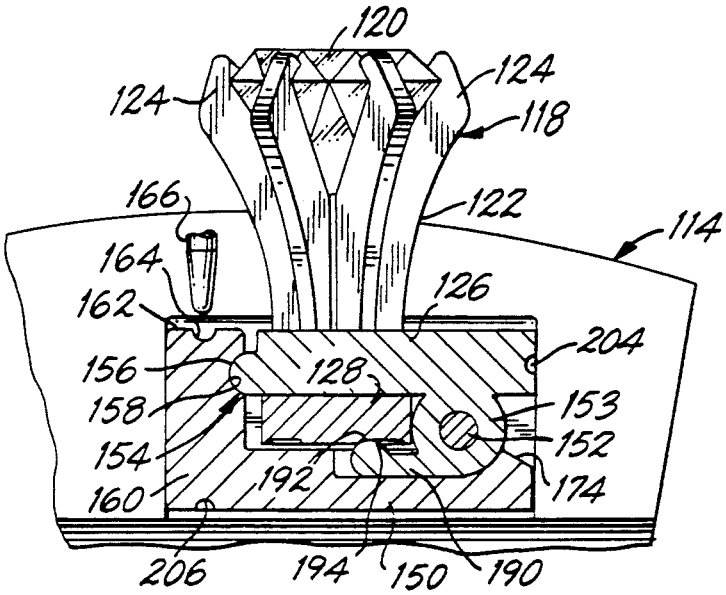
Figure 10:
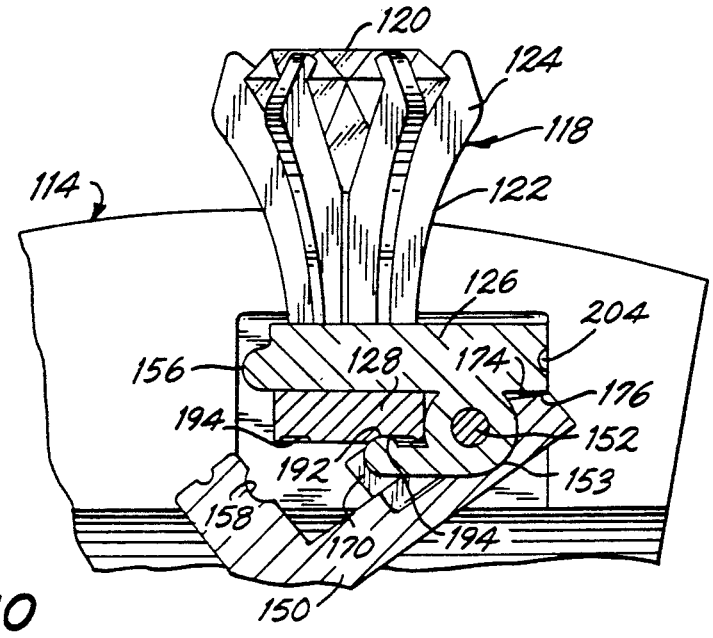
Figure 11:
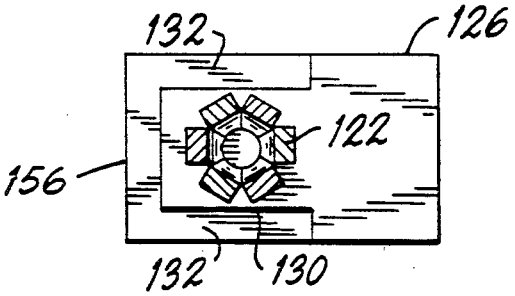
Figure 13:
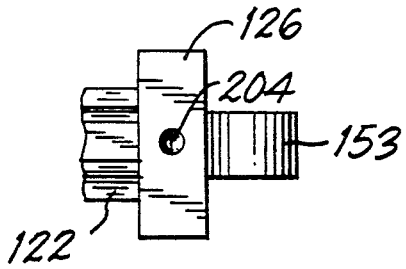
Figure 12:
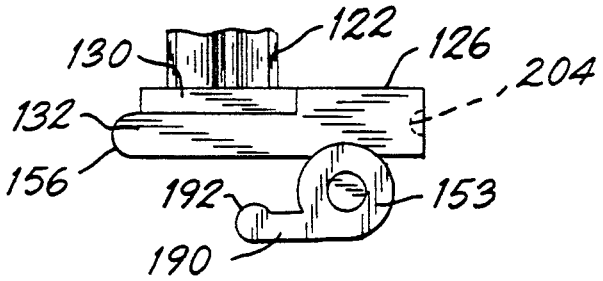
Figure 14:
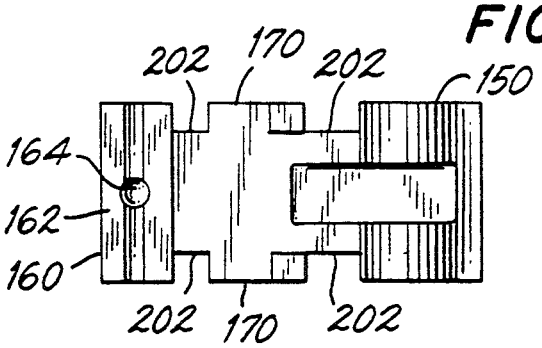
Figure 16:
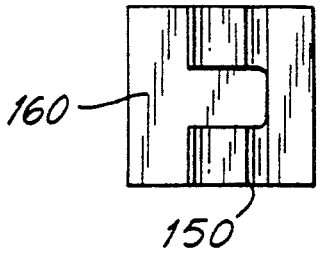
Figure 15:
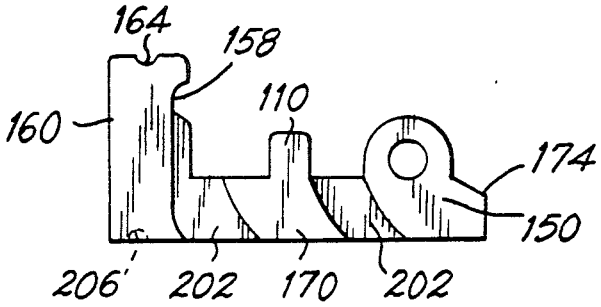
Figure 17:
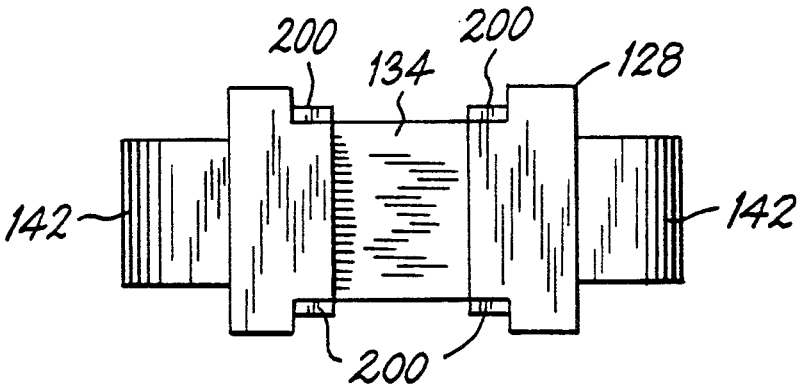
Figure 18:
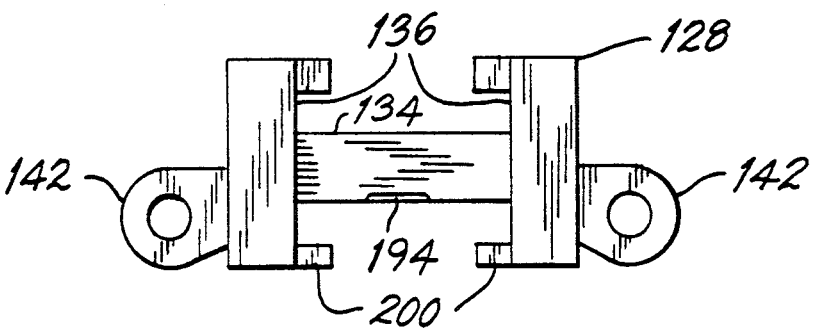
Figure 19:
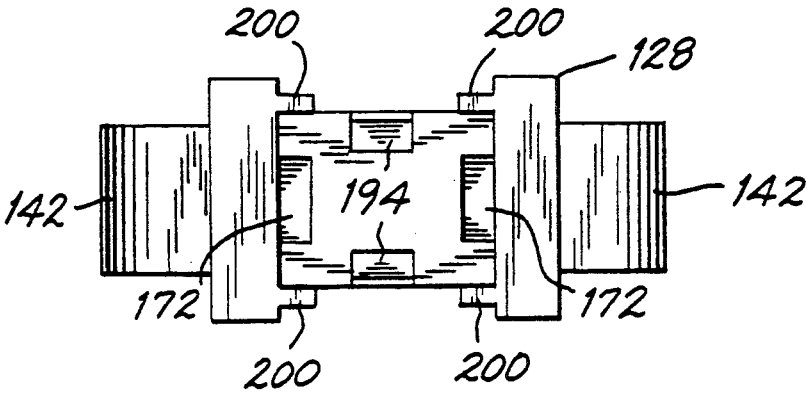

FIG. 7 a further exploded view of the embodiment of FIG. 6;

FIG. 8 is an enlarged lateral cross-sectional view taken along line 8—8 of FIG. 6;

FIG. 9 is an enlarged longitudinal cross-sectional view similar to that of FIG. 4, but illustrating the embodiment of FIG. 6;

FIG. 10 is a view similar to FIG. 9, but with the component parts in another position;

FIG. 11 is a top plan view of a component of the improvement shown in FIG. 6;

FIG. 12 is a fragmentary front elevational view in the direction indicated by line 12—12 of FIG. 11;

FIG. 13 is a fragmentary end elevational view in the direction indicated by line 13—13 of FIG. 11;

FIG. 14 is a top plan view of another component of the improvement shown in FIG. 6;

FIG. 15 is a front elevational view taken in the direction indicated by line 15—15 of FIG. 14;

FIG. 16 is an end elevational view taken in the direction indicated by line 16—16 of FIG. 14;

FIG. 17 is a top plan view of still another component of the improvement shown in FIG. 6;

FIG. 18 is a front elevational view taken in the direction indicated by line 18—18 of FIG. 17; and FIG. 19 is a bottom plan view taken in the direction indicated by line 19—19 of FIG. 18.

Figure 1:
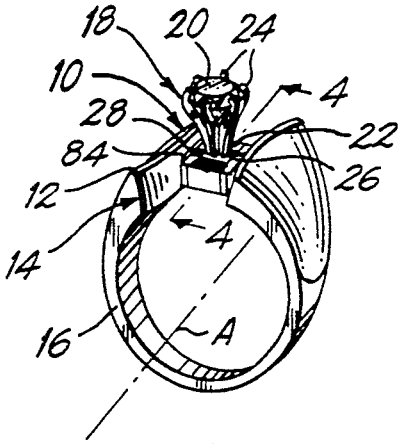
FIG. 1 is a pictorial perspective view of a jeweled ring incorporating the improvement of the present invention.

Referring now to the drawing, and especially to FIG. 1 thereof, a jewelry piece 10 is illustrated in the form of a jeweled ring 12 including a support 14 in the form of a ring 16 of precious metal and an ornament 18 in the form of a gemstone 20 held in place in a setting 22. The gemstone 20 is of a conventional cut and is held in the setting 22 by conventional means including a plurality of securing prongs 24.

Figure 2:
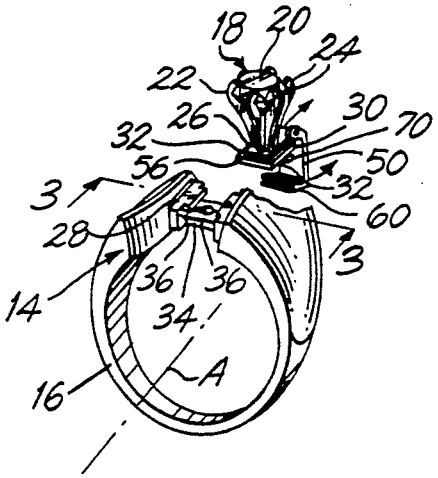
FIG. 2 is an exploded pictorial perspective view of the jeweled ring of FIG. 1.

As best seen in FIG. 2, jeweled ring 12 incorporates the improvement of the present invention to enable the ornament 18 to be selectively released from the support 14. Thus, prongs 24 are integral with a basal platform 26 which is selectively secured to and released from a bridge 28 coupled to the support 14. Basal platform 26 includes a first connector element in the form of a spline 30 unitary with the basal platform 26. Spline 30 extends longitudinally along the basal platform 26, projects altitudinally downwardly therefrom and includes ribs 32 extending longitudinally along laterally opposite edges of the spline 30 to establish a generally T-shaped lateral cross-sectional configuration in the spline 30. Bridge 28 includes a second connector element in the form of a groove 34 extending longitudinally along the bridge 28, laterally across the bridge between opposite sides 36, and altitudinally downwardly into the bridge 28 to establish a generally T-shaped cross-sectional configuration complementary to the cross-sectional configuration of the spline 30. Ornament 18 is affixed to support 14 by sliding spline 30 into groove 34, in a longitudinal direction parallel to the central axis A of the ring 16, until the basal platform 26 is fully seated within the bridge 28 and secured therein, all in a manner which will be explained in greater detail below.

Figure 3:
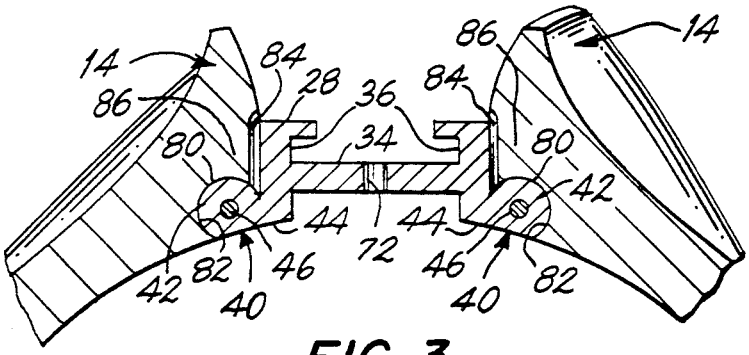
FIG. 3 is an enlarged lateral cross-sectional view taken along line 3—3 of FIG. 2.
Figure 5:
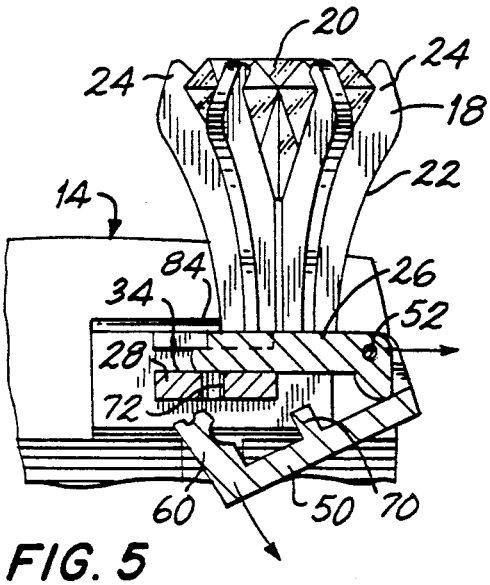
FIG. 5 is a view similar to FIG. 4, but with component parts in another position.

Turning now to FIGS. 3 through 5, bridge 28 is coupled to support 14 at laterally opposite coupling locations 40 adjacent the laterally opposite sides 36 of the groove 34 in the bridge 28. A pair of ears 42 on the bridge 28 project laterally outwardly and enter complementary notches 44 in the support 14. A coupling pin 46 extends longitudinally through each ear 42 and into the surrounding portions of the support 14 to affix the bridge 28 within the support 14. As best seen in FIG. 4, when the basal platform 26 is fully seated upon the bridge 28, the basal platform 26 is in a home position and a latch 50 secures the basal platform 26 in the home position. Latch 50 is mounted upon the basal platform 26 by a pivot pin 52 which extends in a lateral direction, generally perpendicular to the longitudinal direction of extent of the spline 30 and the groove 34, through the latch 50 at one end of the latch 50, so that the latch 50 is selectively pivoted between the latched position illustrated in FIGS. 1 and 4, and an unlatched position, shown in FIG. 2. In the latched position, the latch 50 is held in place by catch means shown in the form of a detent 54 located at the other end of the latch 50. Detent 54 includes a ledge 56 on the basal platform 26 and a complementary channel 58 on an altitudinally upwardly directed lever 60 on the latch 50. When the basal platform 26 is fully seated in the home position and the latch 50 is secured by detent 54, as illustrated in FIGS. 1 and 3, the bridge 28 is captured between the basal platform 26 and the latch 50 and the ornament 18 is secured to the support 14. The complementary T-shaped cross-sectional configurations precludes relative movement between the basal platform 26 and the bridge 28 in lateral and altitudinal directions, while the latch 50, when latched, precludes relative movement in longitudinal directions.

When it is desired to release the ornament 18 from the support 14, an altitudinally downward force is applied to upper tip 62 of the lever 60 to open the detent 54 and pivot the latch 50 from the latched position toward the unlatched position. A small notch 64 at the tip 62 of the lever 60 facilitates the seating of a pointed instrument 66, such as a pen tip or any commonly available implement, within the notch 64 for pushing the lever 60 downwardly to open the detent 54 and release the latch 50 for pivotal movement toward the unlatched position, as seen in FIG. 5. Release of the latch 50 enables sliding of the spline 30 from the groove 34 and release of the basal platform 26 from the bridge 28 to detach the ornament 18 from the support 14. In this manner, the ornament 18 is released from the support 14 for selective attachment to any one of a variety of support structures, all of which carry a bridge 28. Thus, a bridge 28 may be coupled to any one of a number of rings 16 of different configurations so that the same gemstone 20 can serve as the ornamental element in any one of several jeweled rings of a variety of styles. Likewise, bridge 28 may be coupled to a necklace, a bracelet or other articles of jewelry so that gemstone 20, within the setting 22, is secured readily to any one of a variety of jeweled articles.

A safety feature is incorporated into the illustrated arrangement in the form of a supplemental locking means which includes a projection 70 integral with the latch 50 and extending altitudinally upwardly from the latch 50 intermediate the opposite ends of the latch 50. A complementary recess in the form of aperture 72 in the bridge 28 is engaged by the projection 70 when the basal platform 26 is in the home position and the latch 50 is in the latched position, as illustrated in FIG. 4. Should the detent 54 inadvertently be released and the latch 50 moved out of the latched position to an intermediate position between the latched position and the unlatched position, as illustrated in phantom in FIG. 4, the projection 70 will remain engaged in the aperture 72 and deter movement of the basal platform 26 out of the bridge 28. Only upon deliberate movement of the latch 50 to the unlatched position will the basal platform 26 be released for movement out of the bridge 28.

Bridge 28 is constructed of a material having the requisite strength and wear resistance to withstand the rigors of use without distortion of the groove 34 and any consequent interference with the ready engagement and disengagement of spline 30 and groove 34. While bridge 28 can be constructed of a high strength, wear resistant material such as stainless steel, the preferred material for a ring 16 of precious metal is a very hard eighteen carat white gold alloy. In order to deter distortion of the bridge 28 under circumstances where bending moments may be applied to the bridge 28 at the coupling locations 40, the ears 42 are provided with arcuate shoulders 80, each arcuate shoulder 80 being centered on a corresponding coupling pin 46. The notches 44 have a complementary arcuate configuration at 82 and a clearance gap 84 adjacent the corresponding side of the bridge 28 so that each coupling pin 46 serves as a hinge pin enabling some swinging movement of the portions 86 of the support 14 relative to the bridge 28 adjacent the coupling locations 40 in response to bending moments at the coupling locations 40. In this manner, the bridge 28 is isolated from such bending moments and thereby resists distortion as a result of these bending moments. The bending moments may be induced by thermal expansion or contraction of the ring 16, by sizing operations wherein the ring 16 is made smaller or larger, with concomitant stresses exerted at the coupling locations 40, or merely by impacts encountered during ordinary use. Similarly, where bridge 28 is coupled to a bracelet, a necklace or another article of jewelry, forces can be encountered which, if transmitted through the coupling means, could distort the bridge 28 and impede the ease of operation of the spline 30 and groove 34 attachment of the present invention. The above-described coupling arrangement assures appropriate operation under essentially all such circumstances.

The ability to effect attachment and detachment of the ornament 18 and the support 14 merely by moving the ornament 18 linearly in one longitudinal direction, and parallel to the central axis A where the support 14 is the ring 16, opens up the possibility of a very wide range of designs and styles in the support 14 while maintaining exceptional ease of attachment and detachment. The present construction provides a relatively compact arrangement in which the setting 22 is carried by the basal platform 26 in an unobtrusive manner, enabling the accommodation of a wide variety of ornamental elements including gemstones of a wide range of sizes and cuts, and especially larger gemstones, to maintain an aesthetically pleasing jewelry article. The ability merely to slide one component longitudinally relative to the other, without requiring the release of a complex number of further component parts, renders a practical reality the selective assembly of a particular combination of ornament and support by an end user of the article of jewelry. The construction enables standardization so that the end user is able to purchase ornaments or supports from a variety of suppliers and readily can assemble such ornaments or supports with complementary components already in the purchaser's wardrobe, without requiring the assistance of a professional craftsman.

Referring now to FIGS. 6 through 19, another embodiment of the improvement of the present invention is shown in connection with a jewelry piece 110, illustrated in the form of a jeweled ring 112 including a support 114 comprised of a ring 116 of precious metal and an ornament 118 comprised of a gemstone 120 held in place in a setting 122. The gemstone 120 is of a conventional cut and is held in the setting 122 by conventional means including a plurality of securing prongs 124.

As best seen in FIG. 6, jeweled ring 112 incorporates the improvement of the present invention to enable the ornament 118 to be selectively released from the support 114. Thus, prongs 124 are integral with a basal platform 126 which is selectively secured to and released from bridge 128 coupled to the support 114. Basal platform 126 includes a first connector element in the form of a spline 130 unitary with the basal platform 126. Spline 130 extends longitudinally along the basal platform 126, projects altitudinally downwardly therefrom and includes ribs 132 extending longitudinally along laterally opposite edges of the spline 130 to establish a generally T-shaped lateral cross-sectional configuration in the spline 130. Bridge 128 includes a second connector element in the form of a groove 134 extending longitudinally along the bridge 128, laterally across the bridge between opposite sides 136, and altitudinally downwardly into the bridge 128 to establish a generally T-shaped cross-sectional configuration complementary to the cross-sectional configuration of the spline 130. Ornament 118 is affixed to support 114 by sliding spline 130 into groove 134, in a longitudinal direction parallel to the central axis AA of the ring 116, until the basal platform 126 is fully seated within the bridge 128 and secured therein, all in a manner which will be explained in greater detail below.

Turning now to FIGS. 7 through 10, bridge 128 is coupled to support 114 at laterally opposite coupling locations 140 adjacent the laterally opposite sides 136 of the groove 134 in the bridge 128. A pair of ears 142 on the bridge 128 project laterally outwardly and enter complementary notches 144 in the support 114. A coupling pin 146 extends longitudinally through each ear 142 and into the surrounding portions of the support 114 to affix the bridge 128 within the support 114. As best seen in FIG. 9, when the basal platform 126 is fully seated upon the bridge 128, the basal platform 126 is in a home position and a latch 150 secures the basal platform 126 in the home position. Latch 150 is mounted upon the basal platform 126 by a pivot pin 152 which extends in a lateral direction, generally perpendicular to the longitudinal direction of extent of the spline 130 and the groove 134, through a depending bushing 153 integral with the latch 150 adjacent one end of the latch 150, so that the latch 150 is selectively pivoted between the latched position illustrated in FIG. 9 and an unlatched position, shown in FIG. 10. In the latched position, the latch 150 is held in place by catch means shown in the form of a detent 154 located at the other end of the latch 150. Detent 154 includes a ledge 156 on the basal platform 126 and a complementary channel 158 on an altitudinally upwardly directed lever 160 on the latch 150. When the basal platform 126 is fully seated in the home position and the latch 150 is secured by detent 154, as illustrated in FIG. 9, the bridge 128 is captured between the basal platform 126 and the latch 150 and the ornament 118 is secured to the support 114. The complementary T-shaped cross-sectional configurations precludes relative movement between the basal platform 126 and the bridge 128 in lateral and altitudinal directions, while the latch 150, when latched, precludes relative movement in longitudinal directions.

When it is desired to release the ornament 118 from the support 114, an altitudinally downward force is applied to upper tip 162 of the lever 160 to open the detent 154 and pivot the latch 150 from the latched position toward the unlatched position. A small indentation 164 at the tip 162 of the lever 160 facilitates the seating of a pointed instrument 166, such as a pen tip or any commonly available implement, within the indentation 164 for pushing the lever 160 downwardly to open the detent 154 and release the latch 150 for pivotal movement toward the unlatched position, as seen in FIG. 10. Release of the latch 150 enables sliding of the spline 130 from the groove 134 and release of the basal platform 126 from the bridge 128 to detach the ornament 118 from the support 114. In this manner, the ornament 118 is released from the support 114 for selective attachment to any one of a variety of support structures, all of which carry a bridge 128, all as described above in connection with the embodiment of FIGS. 1 through 5.

A safety feature is incorporated into the illustrated arrangement in the form of a supplemental locking means which includes projections 170 integral with the latch 150 and extending altitudinally upwardly, one projection 170 from each side of the latch 150 intermediate the opposite ends of the latch 150. Complementary recesses in the form of apertures 172 in the bridge 128, located adjacent the laterally opposite sides 136 of the groove 134 in the bridge 128, are engaged by the respective projections 170 when the basal platform 126 is in the home position and the latch 150 is in the latched position, as illustrated in FIG. 9. Should the detent 154 inadvertently be release and the latch 150 moved out of the latched position to an intermediate position between the latched position and the unlatched position, the projections 170 will remain engaged in the apertures 172 and deter movement of the basal platform 126 out of the bridge 128. Only upon deliberate movement of the latch 150 to the fully unlatched position will the basal platform 126 be released for movement out of the bridge 128. Upon reaching the fully unlatched position of the latch 150, a stop shoulder 174 on the latch 150 will engage the basal platform 126 adjacent the corresponding end of the platform 126, as illustrated at 176 in FIG. 10, to provide a positive and tactile indication that the fully unlatched position has been reached.

As in the earlier-described embodiment, bridge 128 is constructed of a material having the requisite strength and wear resistance to withstand the rigors of use without distortion of the groove 134 and any consequent interference with the ready engagement and disengagement of spline 130 and groove 134. While bridge 128 can be constructed of a high strength, wear resistant material such as stainless steel, the preferred material for a ring 116 of precious metal is a very hard eighteen carat white gold alloy. In order to deter distortion of the bridge 128 under circumstances where bending moments may be applied to the bridge 128 at the coupling locations 140, the ears 142 are provided with arcuate shoulders 180, each arcuate shoulder 180 being centered on a corresponding coupling pin 146. The notches 144 have a complementary arcuate configuration at 182 and a clearance gap 184 adjacent the corresponding side of the bridge 128 so that each coupling pin 146 serves as a hinge pin enabling some swinging movement of the portions 186 of the support 114 relative to the bridge 128 adjacent the coupling locations 140 in response to bending moments at the coupling locations 140. In this manner, the bridge 128 is isolated from such bending moments and thereby resists distortion as a result of these bending moments. The bending moments may be induced by thermal expansion or contraction of the ring 116, by sizing operations wherein the ring 116 is made smaller or larger, with concomitant stresses exerted at the coupling locations 140, or merely by impacts encountered during ordinary use. Similarly, where bridge 128 is coupled to a bracelet, a necklace or another article of jewelry, forces can be encountered which, if transmitted through the coupling means, could distort the bridge 128 and impede the ease of operation of the spline 130 and groove 134 attachment of the present invention. The above-described coupling arrangement assures appropriate operation under essentially all such circumstances.

The embodiment of FIGS. 6 through 19 includes several further safety and convenience features. As best seen in FIGS. 11 through 19, as well as in FIGS. 6 through 10, the placement of the pivot pin 152 spaced from the platform 126, below the platform 126, and intermediate the ends of the platform 126, provides a more compact arrangement and enables the fully unlatched position to be reached with less swinging displacement of the latch 150. Further, the arrangement provides the positive stop indication when the stop shoulder 174 engages the platform 126 at 176. In addition, a finger 190 extends longitudinally from a near end at the bushing 153, essentially parallel to the platform 126, and includes a first detent element 192 at the far end thereof. Upon seating the basal platform 126 on the bridge 128, the detent element 192 engages a second detent element in the form of a relatively shallow indentation 194 in the bridge 128. That engagement provides a tactile as well as an audible indication, in the nature of a snapping sound, of reaching the home position, as well as providing additional means for securing the basal platform 126 in the home position, prior to latching the latch 150.

The configuration of the bridge 128 is symmetrical in the longitudinal direction so that the basal platform 126 may be placed over the bridge 128 from either end of the bridge 128 by movement in either of the two opposite longitudinal directions. To that end, a shallow indentation 194 is provided adjacent each end of the bridge 128, and the apertures 172 are centered longitudinally along the bridge 128, between the ends of the bridge 128, so as to be engaged by the projections 170 regardless of the relative longitudinal orientation of the basal platform 126 and the bridge 128. The location of the projections 170 at each side of the latch 150, intermediate the ends of the latch 150, enables the portions 200 of the bridge 128 adjacent the apertures 172 to become seated within corresponding portions 202 of the latch 150, when the latch 150 is in the fully latched position, for greater integrity of the connection between the basal platform 126 and the bridge 128. The inclusion of indentations at 204 in the end of the basal platform 126 adjacent the pivot pin 152 eases the location of a pushing tool against that end of the basal platform 126 during assembly. Latching is facilitated by the provision of an indentation at 206 on the latch 150, which indentation 206 assists in locating a pushing implement against the latch 150.

It will be seen that the present invention provides an improvement in an article of jewelry of the type in which the ornamental portion of the article is secured or released selectively from the support portion of the article, and attains the aforesaid several objects and advantages, some of which have been summarized as follows: Provides a jewelry system of simplified construction which is used readily by the wearer of jewelry to assemble a particular combination of ornament and support selected from a wide variety of such combinations made available by the improvement; enhances the ability to tailor a jewelry article to a particular style of dress without unduly multiplying the number of expensive ornaments required to provide a wide range of ornamented articles; opens new fields of fashion by rendering a wide variety of jewelry articles more available at lowered expense; provides a construction which is universal in the ability to accommodate almost any available ornamental element, including gemstones of essentially all sizes and cuts, so that the ornament is available for selection and placement by the wearer in combination with any one of a wide variety of supports; enables ease of interchange of the ornamental portion of an article of jewelry while providing a high degree of security once the ornamental portion is affixed to the support; avoids deleterious effects of stresses tending to distort the construction and impede ease of operation; and enables the construction of a highly desirable jewelry system of utmost quality and exemplary performance over a long service life.

It is to be understood that the above detailed description of preferred embodiments of the invention is provided by way of example only. Various details of design and construction may be modified without departing from the true spirit and scope of the invention as set forth in the appended claims.

What is claimed is:

1. An improvement in an article of jewelry of the type in which an ornament is selectively secured to or released from a support, the support including a longitudinal axis, the improvement comprising:

a basal platform affixed to the ornament and having a first connector element extending longitudinally along the basal platform;

a bridge coupled with the support and having a second connector element extending longitudinally along the bridge essentially parallel to the longitudinal axis and including laterally opposite sides;

the first connector element and the second connector element having complementary lateral cross-sectional configurations such that the first connector element is engaged with the second connector element for longitudinally sliding movement essentially parallel to the longitudinal axis into and out of a home position wherein the basal platform is fully seated upon the bridge, while relative movement between the first and second connector elements in lateral and altitudinal directions is precluded;

a latch mounted for selective pivotal movement about a lateral axis transverse to the longitudinal axis between a latched position, wherein the bridge is captured between the basal platform and the latch for securement of the basal platform against movement relative to the bridge, and an unlatched position wherein the basal platform is free to move longitudinally relative to the bridge;

clasp means for selectively securing the latch in the latched position when the first connector element is in the home position and for selective release from the latched position for permitting movement of the first connector element out of the home position; and coupling means for coupling the bridge with the support at coupling locations spaced apart laterally and placed adjacent respective corresponding opposite sides of the second connector element such that the second connector element extends longitudinally intermediate the coupling locations and is spaced laterally from the coupling locations;

whereby the selective securement and release of the ornament is accomplished solely by movement of the latch between the latched and unlatched positions and longitudinal sliding of the first connector element relative to the second connector element.

2. The improvement of claim 1 wherein one of the first and second connector elements is a spline and the other of the first and second connector elements is a groove.

3. The improvement of claim 1 wherein the first connector element is a longitudinally extending spline and the second connector element is a longitudinally extending groove.

4. The improvement of claim 3 wherein the complementary cross-sectional configurations of the spline and the groove are generally T-shaped.

5. The improvement of claim 3 wherein the coupling means includes a hinged joint solely coupling the bridge with the support at each coupling location for permitting swinging movement of the support relative to the bridge at the coupling locations so as deter distortion of the bridge by bending moments at portions of the support adjacent the coupling locations.

6. The improvement of claim 5 wherein each hinged joint includes an ear integral with the bridge and extending laterally away from the groove, and a hinge pin extending longitudinally through the corresponding ear and into the support at each coupling location.

7. The improvement of claim 6 wherein the coupling means includes a clearance gap between the bridge and the support adjacent each ear for facilitating the swinging movement of the support relative to each ear.

8. The improvement of claim 3 wherein the latch is mounted for pivotal movement on the basal platform and the lateral axis extends essentially perpendicular to the spline.

9. The improvement of claim 8 wherein the latch includes opposite ends, the lateral axis is located adjacent one of the opposite ends of the latch and the clasp means is located adjacent the other of the opposite ends of the latch.

10. The improvement of claim 9 wherein the clasp means includes a detent for catching the corresponding end of the latch on the platform.

11. The improvement of claim 9 wherein the lateral axis is spaced from the platform altitudinally opposite the ornament.

12. The improvement of claim 11 including a finger carried by the platform and extending longitudinally generally parallel to the platform and spaced from the platform altitudinally opposite the ornament, the finger including a first detent element, and a second detent element complementary to the first detent element and located on the bridge for reception of the first detent element when the spline is in the home position.

13. The improvement of claim 12 wherein the bridge includes longitudinally opposite ends and a said second detent element is located adjacent each of the opposite ends, whereby the bridge is longitudinally symmetrical.

14. The improvement of claim 3 including supplemental locking means for engagement when the latch is in an intermediate position between the latched position and the unlatched position to deter relative longitudinal movement between the basal platform and the bridge until the latch is moved, further toward the unlatched position.

15. The improvement of claim 14 wherein the supplemental locking means includes a projection extending in an altitudinal direction and a recess extending in an altitudinal direction, the recess being complementary to the projection, the altitudinal extent of the projection and the relative location of the projection and the recess being such that the projection enters the recess when the spline is in the home position within the groove and the latch is in the intermediate position so as to preclude sliding movement of the spline out of the groove until the projection is fully retracted from the recess.

16. The improvement of claim 15 wherein the latch is mounted for pivotal movement on the basal platform and the lateral axis extends essentially perpendicular to the spline, the latch includes opposite ends, the lateral axis is located at one of the opposite ends of the latch and the clasp means is located at the other of the opposite ends of the latch, and wherein the projection is on the latch intermediate the opposite ends of the latch, and the recess is in a counterpart location on the bridge.

17. The improvement of claim 14 wherein the supplemental locking means includes a pair of projections, each projection extending in an altitudinal direction, and a corresponding pair of recesses, each recess extending in an altitudinal direction, each recess being complementary to a corresponding projection, the altitudinal extent of each projection and the relative location of each projection and the corresponding recess being such that each projection enters the corresponding recess when the spline is in the home position within the groove and the latch is in the intermediate position so as to preclude sliding movement of the spline out of the groove until the projections are fully retracted from the recesses.

18. The improvement of claim 17 wherein the latch is mounted for pivotal movement on the basal platform and the lateral axis extends essentially perpendicular to the spline, the latch includes laterally opposite sides and longitudinally opposite ends, the lateral axis is located adjacent one of the opposite ends of the latch and the class means is located adjacent the other of the opposite ends of the latch, and wherein the projections are on the latch, at the opposite sides, intermediate the opposite ends of the latch, and the recesses are in counterpart locations on the bridge.

19. The improvement of claim 18 wherein the bridge includes longitudinally opposite ends and the recesses are located longitudinally centrally between the opposite ends of the bridge, whereby the bridge is longitudinally symmetrical.

20. The improvement of claim 1 wherein the support is a ring having a central axis essentially parallel to the longitudinal axis and the first and second connector elements extend longitudinally parallel to the central axis of the ring.

21. The improvement of claim 20 wherein one of the first and second connector elements is a spline and the other of the first and second connector elements is a groove.

22. The improvement of claim 20 wherein the first connector element is a longitudinally extending spline and the second connector element is a longitudinally extending groove.

23. The improvement of claim 22 wherein the complementary cross-sectional configurations of the spline and the groove are generally T-shaped.

24. The improvement of claim 22 wherein the coupling means includes a hinged joint at each location for permitting swinging movement of the ring relative to the bridge at the coupling locations so as deter distortion of the bridge by bending moments at portions of the ring adjacent the coupling locations.

25. The improvement of claim 24 wherein each hinged joint includes an ear integral with the bridge and extending laterally away from the groove, and a hinge pin extending longitudinally through the corresponding ear and into the ring at each coupling location.

26. The improvement of claim 25 wherein the coupling means includes a clearance gap between the bridge and the ring adjacent each ear for facilitating the swinging movement of the ring relative to each ear.

* * * * *